US009942973B2

(12) United States Patent
Abe et al.

(10) Patent No.: US 9,942,973 B2
(45) Date of Patent: Apr. 10, 2018

(54) EXTREME ULTRAVIOLET LIGHT GENERATION APPARATUS

(71) Applicant: GIGAPHOTON INC., Tochigi (JP)

(72) Inventors: Tamotsu Abe, Oyama (JP); Yoshifumi Ueno, Oyama (JP); Hirokazu Hosoda, Oyama (JP); Takashi Saito, Oyama (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 15/480,400

(22) Filed: Apr. 6, 2017

(65) Prior Publication Data

US 2017/0215267 A1 Jul. 27, 2017

Related U.S. Application Data

(63) Continuation of application No. PCT/JP2014/080721, filed on Nov. 20, 2014.

(51) Int. Cl.
*H05G 2/00* (2006.01)
*G21K 1/06* (2006.01)

(52) U.S. Cl.
CPC ..... *H05G 2/008* (2013.01); *G21K 1/06* (2013.01); *H05G 2/005* (2013.01)

(58) Field of Classification Search
None
See application file for complete search history.

(56) References Cited

U.S. PATENT DOCUMENTS 7,872,245 B2 1/2011 Vaschenko et al.
2003/0223546 A1 12/2003 McGregor et al.
2006/0024216 A1 2/2006 Hergenhan et al.
2009/0272919 A1* 11/2009 Abe ..... G03F 7/70033 250/504 R
2010/0019173 A1 1/2010 Someya et al.
(Continued)

FOREIGN PATENT DOCUMENTS

JP 2004-006365 A 1/2004
JP 2004006365 A * 1/2004 ..... H05G 2/003
(Continued)

OTHER PUBLICATIONS

International Search Report issued in PCT/JP2014/080721; dated Feb. 17, 2015.
(Continued)

*Primary Examiner* — Andrew Smyth
(74) *Attorney, Agent, or Firm* — Studebaker & Brackett PC

(57) ABSTRACT

An extreme ultraviolet light generation apparatus may be configured to generate extreme ultraviolet light by irradiating a target with a pulse laser beam outputted from a laser apparatus to generate plasma. The extreme ultraviolet light generation apparatus may include a chamber; a target supply device configured to supply a target to a plasma generation region inside the chamber; a target sensor located between the target supply device and the plasma generation region and configured to detect the target passing through a detection region; and a shield cover disposed between the detection region and the target supply device, having a through-hole that allows the target to pass through, and configured to reduce pressure waves that reach the target supply device from the plasma generation region.

17 Claims, 13 Drawing Sheets

(56) References Cited

U.S. PATENT DOCUMENTS

| | | | | |
|---|---|---|---|---|
| 2011/0174996 | A1 | 7/2011 | Someya et al. | |
| 2012/0236273 | A1 | 9/2012 | Kameda et al. | |
| 2013/0048878 | A1* | 2/2013 | Mizoguchi ..... | H05G 2/005<br>250/492.1 |
| 2013/0186567 | A1* | 7/2013 | Yanagida ..... | H05G 2/006<br>156/345.24 |
| 2014/0070021 | A1 | 3/2014 | Yabu et al. | |

FOREIGN PATENT DOCUMENTS

| | | | |
|---|---|---|---|
| JP | 2005-026056 | A | 1/2005 |
| JP | 2006-074005 | A | 3/2006 |
| JP | 2008-103206 | A | 5/2008 |
| JP | 2008-270533 | A | 11/2008 |
| JP | 2012-199005 | A | 10/2012 |
| JP | 2013-051349 | A | 3/2013 |
| JP | 2013-152845 | A | 8/2013 |
| JP | 2014-056891 | A | 3/2014 |

OTHER PUBLICATIONS

Written Opinion issued in PCT/JP2014/080721; dated Feb. 17, 2015.

* cited by examiner

EXTREME ULTRAVIOLET LIGHT GENERATION APPARATUS

CROSS-REFERENCE TO RELATED APPLICATIONS

The present application is a continuation application of International Application No. PCT/JP2014/080721 filed on Nov. 20, 2014, the content of which is hereby incorporated by reference into this application.

BACKGROUND

1. Technical Field

The present disclosure relates to an extreme ultraviolet light generation apparatus.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 70 nm to 45 nm, and further, microfabrication with feature sizes of 32 nm or less will be required. In order to meet the demand for microfabrication with feature sizes of 32 nm or less, for example, an exposure apparatus is needed in which a system for generating extreme ultraviolet (EUV) light at a wavelength of approximately 13 nm is combined with a reduced projection reflective optical system.

Three kinds of systems for generating EUV light are known in general, which include a Laser Produced Plasma (LPP) type system in which plasma is generated by irradiating a target material with a laser beam, a Discharge Produced Plasma (DPP) type system in which plasma is generated by electric discharge, and a Synchrotron Radiation (SR) type system in which orbital radiation is used to generate plasma.

SUMMARY

An example of the present disclosure may be an extreme ultraviolet light generation apparatus configured to generate extreme ultraviolet light by irradiating a target with a pulse laser beam outputted from a laser apparatus to generate plasma. The extreme ultraviolet light generation apparatus may include a chamber; a target supply device configured to supply a target to a plasma generation region inside the chamber; a target sensor located between the target supply device and the plasma generation region and configured to detect the target passing through a detection region; and a shield cover disposed between the detection region and the target supply device, having a through-hole that allows the target to pass through, and configured to reduce pressure waves that reach the target supply device from the plasma generation region.

BRIEF DESCRIPTION OF THE DRAWINGS

Hereinafter, selected embodiments of the present disclosure will be described with reference to the accompanying drawings.

DETAILED DESCRIPTION

Contents

Figure 1:
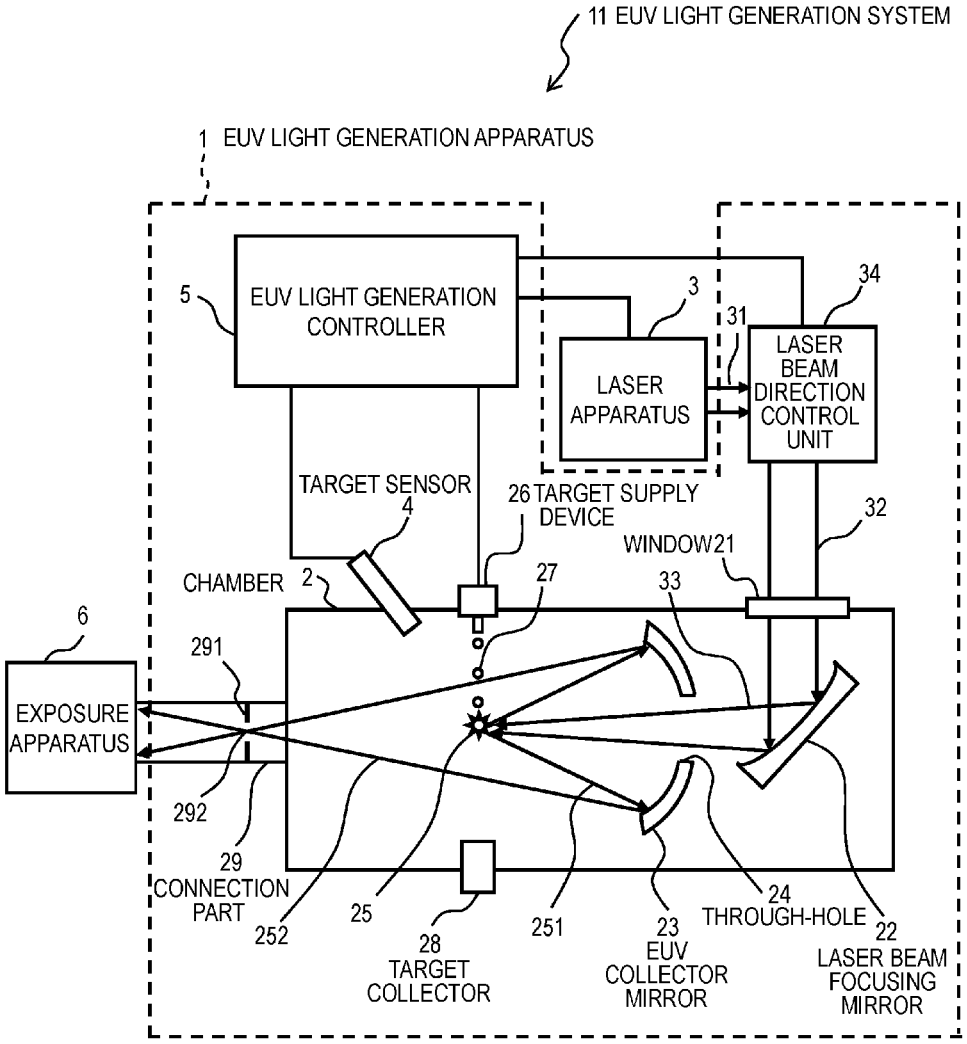
FIG. 1 schematically illustrates an exemplary configuration of an LPP type EUV light generation system.

1. Overview
2. Terms
3. Overview of EUV Light Generation System
   3.1 Configuration
   3.2 Operation
4. EUV Light Generation System in Related Art
   4.1 Configuration
   4.2 Operation
   4.3 Issues
5. Embodiment 1
   5.1 Configuration
   5.2 Operation
   5.3 Effects
6. Embodiment 2
   6.1 Configuration
   6.2 Operation and Effects
7. Embodiment 3
   7.1 Configuration
   7.2 Operation and Effects
8. Embodiment 4
   8.1 Configuration
   8.2 Operation and Effects
9. Embodiment 5
   9.1 Configuration
   9.2 Operation and Effects
10. Embodiment 6
   10.1 Configuration
   10.2 Operation and Effects
11. Embodiment 7

Hereinafter, selected embodiments of the present disclosure will be described in detail with reference to the accompanying drawings. The embodiments to be described below are merely illustrative in nature and do not limit the scope of the present disclosure. Further, the configuration(s) and operation(s) described in each embodiment are not all essential in implementing the present disclosure. Note that like elements are referenced by like reference numerals and characters, and duplicate descriptions thereof will be omitted herein.

1. Overview

An LPP type EUV light generation apparatus may provide a pulse laser beam to a target outputted from a target supply device when the target has reached a plasma generation region. The target may turn into plasma to generate EUV light. The EUV light generation apparatus may output the pulse laser beam from a laser apparatus in accordance with a detection signal from a timing sensor monitoring passage of a target to synchronize the pulse laser beam with a target.

The inventors found that generation of plasma caused by irradiation with a pulse laser beam may cause variation in trajectory among the subsequent targets and further, that the variation in trajectory among the targets may be caused by vibration of the target supply device generated by the pressure waves from the plasma.

When the trajectory varies among targets, the position of the target to be irradiated with a pulse laser beam may vary, so that the EUV light energy or plasma position may vary. Further, if a variation of the trajectory of a target is large, the timing sensor may not be able to detect the target and the pulse laser beam may miss the target. As a result, generation of EUV light may be interrupted.

In an aspect of the present disclosure, an EUV light generation system may include a shield cover which is provided between a target detection region and the target supply device, includes a through-hole for passing the targets therethrough, and serves to reduce the pressure waves that reach the target supply device from the plasma generation region.

In the one aspect of the present disclosure, the shield cover may hamper the pressure waves from plasma from vibrating the target supply device. As a result, the variation in trajectory among targets may be reduced to stabilize the generation of EUV light.

2. Terms

In the present disclosure, a "plasma generation region" may mean a region where generation of plasma for generating EUV light is started. To start generation of plasma in the plasma generation region, it may be required that a target be supplied to the plasma generation region and that a pulse laser beam be focused at the plasma generation region when the target reaches the plasma generation region.

A "target supply device" is a device for supplying a target material such as tin or terbium to be used to generate EUV light into a chamber. The material and the shape of a target are not limited to specific ones as far as the target irradiated with a pulse laser beam can generate EUV light as needed. A "detection region" of a target is a region where a target outputted from the target supply device is detected; a target passing through the detection region is detected by a target sensor.

3. Overview of Euv Light Generation System

3.1 Configuration

FIG. 1 schematically illustrates an exemplary configuration of an LPP type EUV light generation system. An EUV light generation apparatus 1 may be used with at least one laser apparatus 3. Hereinafter, a system that includes the EUV light generation apparatus 1 and the laser apparatus 3 may be referred to as an EUV light generation system 11. As shown in FIG. 1 and described in detail below, the EUV light generation system 11 may include a chamber 2 and a target supply device 26.

The chamber 2 may be sealed airtight. The target supply device 26 may be mounted onto the chamber 2, for example, to penetrate a wall of the chamber 2. A target material to be supplied by the target supply device 26 may include, but is not limited to, tin, terbium, gadolinium, lithium, xenon, or any combination thereof.

The chamber 2 may have at least one through-hole formed in its wall, a window 21 may be installed in the through-hole, and the pulse laser beam 32 outputted from the laser apparatus 3 may travel through the window 21. An EUV collector mirror 23 having, for example, a spheroidal surface may be provided in the chamber 2. The EUV collector mirror 23 may have a first focus and a second focus.

The EUV collector mirror 23 may have a multi-layered reflective film including alternately laminated molybdenum layers and silicon layers formed on the surface thereof. The EUV collector mirror 23 is preferably positioned such that the first focus lies in a plasma generation region 25 and the second focus lies in an intermediate focus (IF) region 292. The EUV collector mirror 23 may have a through-hole 24 formed at the center thereof and a pulse laser beam 33 may travel through the through-hole 24.

The EUV light generation apparatus 1 may include an EUV light generation controller 5 and a target sensor 4. The target sensor 4 may have an imaging function and detect at least one of the presence, trajectory, position, and speed of a target 27.

Further, the EUV light generation system 11 may include a connection part 29 for allowing the interior of the chamber 2 to be in communication with the interior of the exposure apparatus 6. A wall 291 having an aperture may be provided in the connection part 29. The wall 291 may be positioned such that the second focus of the EUV collector mirror 23 lies in the aperture.

The EUV light generation apparatus 1 may also include a laser beam direction control unit 34, a laser beam focusing mirror 22, and a target collector 28 for collecting targets 27. The laser beam direction control unit 34 may include an optical element for defining the travelling direction of the laser beam and an actuator for adjusting the position, the orientation or posture, and the like of the optical element.

3.2 Operation

With reference to FIG. 1, a pulse laser beam 31 outputted from the laser apparatus 3 may pass through the laser beam direction control unit 34 and, as the pulse laser beam 32, travel through the window 21 and enter the chamber 2. The pulse laser beam 32 may travel inside the chamber 2 along at least one beam path, be reflected by the laser beam focusing mirror 22, and strike at least one target 27 as a pulse laser beam 33.

The target supply device 26 may be configured to output the target(s) 27 toward the plasma generation region 25 in the chamber 2. The target 27 may be irradiated with at least one pulse of the pulse laser beam 33. Upon being irradiated with the pulse laser beam, the target 27 may be turned into plasma, and rays of light 251 may be emitted from the plasma.

The EUV light 252 included in the light 251 may be reflected selectively by the EUV collector mirror 23. EUV light 252 reflected by the EUV collector mirror 23 may be focused at the intermediate focus region 292 and be outputted to the exposure apparatus 6. Here, the target 27 may be irradiated with multiple pulses included in the pulse laser beam 33.

The EUV light generation controller 5 may be configured to integrally control the EUV light generation system 11. The EUV light generation controller 5 may be configured to process image data of the target 27 captured by the target sensor 4. Further, the EUV light generation controller 5 may be configured to control: the timing when the target 27 is outputted and the direction into which the target 27 is outputted, for example.

Furthermore, the EUV light generation controller 5 may be configured to control at least one of: the timing when the laser apparatus 3 oscillates, the direction in which the pulse laser beam 33 travels, and the position at which the pulse laser beam 33 is focused. It will be appreciated that the various controls mentioned above are merely examples, and other controls may be added as necessary.

4. Euv Light Generation System in Related Art

4.1 Configuration

Figure 2A:
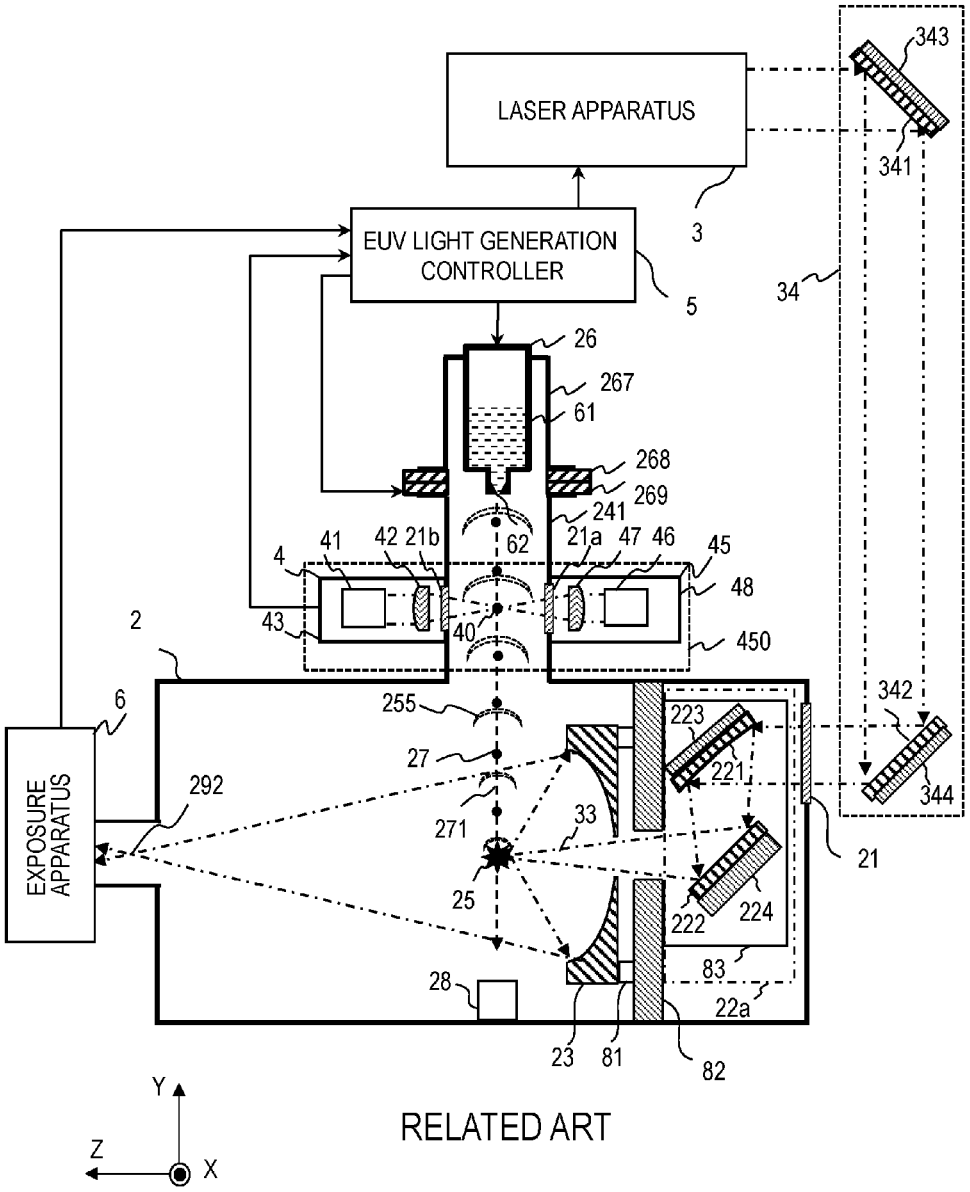
RELATED ART Fig. 2A
FIG. 2A is a cross-sectional diagram of a configuration example of an EUV light generation system in a related art.

FIG. 2A is a cross-sectional diagram of a configuration example of an EUV light generation system 11 in a related art. In FIG. 2A, the y-axis direction is a direction along the trajectory 271 of targets 27. The z-axis direction is a direction perpendicular to the y-axis direction and along the traveling direction of the pulse laser beam 33. The x-axis direction is perpendicular to the y-axis direction and the z-axis direction.

As shown in FIG. 2A, a laser beam focusing optical system 22*a*, an EUV collector mirror 23, a stage 268, a supporter 269, a target collector 28, an EUV collector mirror holder 81, and plates 82 and 83 may be provided within a chamber 2.

The plate 82 may be fixed to the chamber 2. The plate 83 may be fixed to the plate 82. The EUV collector mirror 23 may be fixed to the plate 82 with the EUV collector mirror holder 81.

The laser beam focusing optical system 22*a* may include an off-axis parabolic mirror 221, a flat mirror 222, and holders 223 and 224. The off-axis parabolic mirror 221 and the flat mirror 222 may be held by the holders 223 and 224, respectively. The holders 223 and 224 may be fixed to the plate 83.

The positions and orientations of the off-axis parabolic mirror 221 and the flat mirror 222 may be held so that the pulse laser beam 33 reflected by those mirrors is focused at the plasma generation region 25. The target collector 28 may be disposed upon a straight line extending from the trajectory 271 of targets 27.

The target supply device 26 may be accommodated in and held by a hollow cylindrical container 267. The container 267 may be fixed to the stage 268. The target supply device 26 may be fixed to the stage 268 with the container 267. The stage 268 may be configured to move on the supporter 269 at least in the X-Z plane. The stage 268 and the supporter 269 may be omitted.

The supporter 269 may be secured to a tubular wall 241 projecting along the target trajectory 271 from the sidewall of the chamber 2. The stage 268 may move on the supporter 269 to move the target supply device 26 to a position specified by the EUV light generation controller 5.

The target supply device 26 may include a reservoir 61. The reservoir 61 may hold a target material that has been melted using a heater 261 shown in FIG. 2B. An opening serving as a nozzle opening 62 may be formed in the reservoir 61.

Part of the reservoir 61 may be placed in a through-hole formed in a wall of the chamber 2 so that the nozzle opening 62 formed in the reservoir 61 is positioned inside the chamber 2. The target supply device 26 may supply the melted target material to the plasma generation region 25 within the chamber 2 as droplet-shaped targets 27 through the nozzle opening 62. In the present disclosure, the targets 27 may also be referred to as droplets 27.

A timing sensor 450 may be attached to the wall 241 of the chamber 2. The timing sensor 450 may include a target sensor 4 and a light-emitting unit 45. The target sensor 4 may include a photodetector 41, a light-receiving optical system 42, and a receptacle 43. The light-emitting unit 45 may include a light source 46, an illumination optical system 47, and a receptacle 48. Light outputted from the light source 46 may be focused by the illumination optical system 47. The focal position of the outputted light may be located substantially upon the trajectory 271 of the targets 27.

The target sensor 4 and the light-emitting unit 45 may be disposed opposite to each other on either side of the trajectory 271 of the targets 27. Windows 21*a* and 21*b* may be provided in the chamber 2. The window 21*a* may be positioned between the light-emitting unit 45 and the trajectory 271 of the targets 27. The window 21*b* may be positioned between the photodetector 41 and the trajectory 271 of the targets 27.

The light-emitting unit 45 may focus light at a predetermined region on the trajectory 271 of the targets 27 through the window 21*a*. When a target 27 passes through the focal region 40 of the light emitted from the light-emitting unit 45, the target sensor 4 may detect a change in the light passing through the trajectory 271 of the target 27 and the vicinity thereof. The light-receiving optical system 42 may form, upon a light-receiving surface of the target sensor 4, an image of the trajectory 271 of the target 27 and the vicinity thereof, in order to improve the accuracy of the detection of the target 27. In the example shown in FIG. 2A, the detection region for the target sensor 4 to detect the target 27 may substantially match the focal region 40 of the light emitted from the light-emitting unit 45.

A laser beam direction control unit 34 and an EUV light generation controller 5 may be provided outside the chamber 2. The laser beam direction control unit 34 may include high-reflecting mirrors 341 and 342, and holders 343 and 344. The high-reflecting mirrors 341 and 342 may be held by the holders 343 and 344, respectively. The high-reflecting mirrors 341 and 342 may conduct the pulse laser beam outputted by the laser apparatus 3 to the laser beam focusing optical system 22*a* via the window 21.

The EUV light generation controller 5 may receive a control signal from the exposure apparatus 6. The EUV light generation controller 5 may control the target supply device 26 and the laser apparatus 3 in accordance with the control signal from the exposure apparatus 6.

4.2 Operation

Figure 2B:
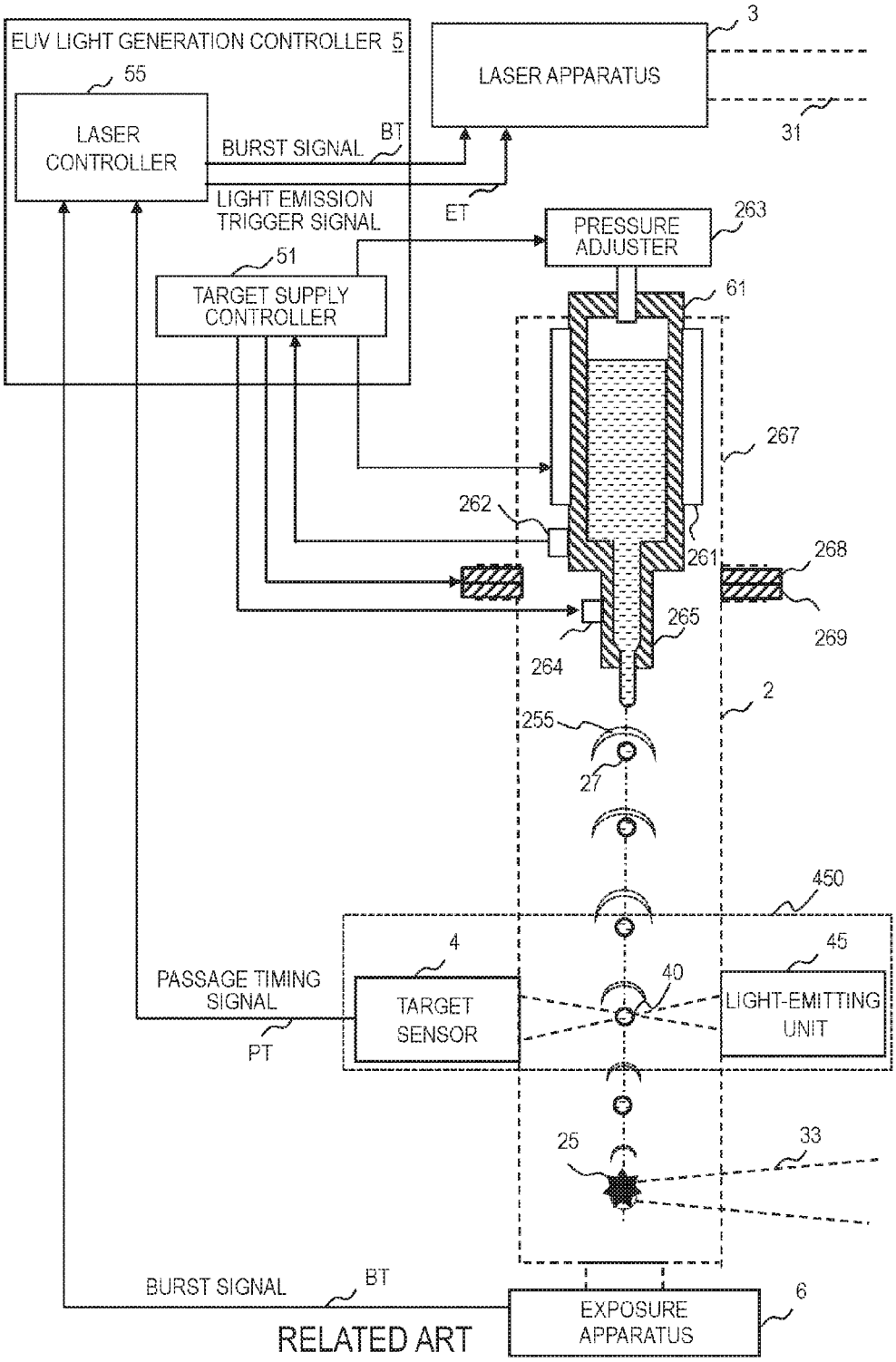
RELATED ART Fig. 2B
FIG. 2B is a block diagram for illustrating control of a target supply device and a laser apparatus by an EUV light generation controller in the related art.

FIG. 2B is a block diagram for illustrating control of the target supply device 26 and the laser apparatus 3 performed by the EUV light generation controller 5 in the related art. The EUV light generation controller 5 may include a target supply controller 51 and a laser controller 55. The target supply controller 51 may control operations performed by the target supply device 26. The laser controller 55 may control operations performed by the laser apparatus 3.

In addition to the reservoir 61 that holds the material of targets 27 in a melted state, the target supply device 26 may include a heater 261, a temperature sensor 262, a pressure adjuster 263, a piezoelectric element 264, and a nozzle 265.

The heater 261 and the temperature sensor 262 may be fixed to the reservoir 61. The piezoelectric element 264 may be fixed to the nozzle 265. The nozzle 265 may have the nozzle opening 62 for outputting targets 27, which are droplets of liquid tin, for example. The pressure adjuster 263 may be provided in a pipe located between a not-shown inert gas supply device and the reservoir 61 to adjust the pressure of the inert gas supplied from the inert gas supply device into the reservoir 61.

The target supply controller 51 may control the heater 261 based on a value detected by the temperature sensor 262. For example, the target supply controller 51 may control the heater 261 so that the reservoir 61 will be at a predetermined temperature higher than or equal to the melting point of the tin. As a result, the reservoir 61 may melt the tin held therewithin. The melting point of tin is 232° C.; the predetermined temperature may be a temperature of 250° C. to 300° C., for example.

The target supply controller 51 may control the pressure within the reservoir 61 using the pressure adjuster 263. The pressure adjuster 263 may adjust the pressure within the reservoir 61 under the control of the target supply controller 51 so that the targets 27 will reach the plasma generation region 25 at a predetermined velocity. The target supply controller 51 may send an electrical signal having a predetermined frequency to the piezoelectric element 264. The piezoelectric element 264 may vibrate in response to the received electrical signal, causing the nozzle 265 to vibrate at the stated frequency.

As a result of the piezoelectric element 264 causing the nozzle opening 62 to vibrate, droplet-shaped targets 27 may be generated from a jet of the liquid tin outputted from the nozzle opening 62. In this manner, the target supply device 26 may supply the droplet-shaped targets 27 to the plasma generation region 25 at a predetermined velocity and a predetermined frequency. For example, the target supply device 26 may generate droplets at a predetermined frequency within a range of several 10 kHz to several 100 kHz.

The timing sensor 450 may detect a target 27 passing through a detection region. When a target 27 passes through the focal region of the light produced by the light-emitting unit 45, the target sensor 4 may detect a change in the light passing through the trajectory of the target 27 and the vicinity thereof and output a passage timing signal PT as a detection signal of the target 27.

Figure 2C:
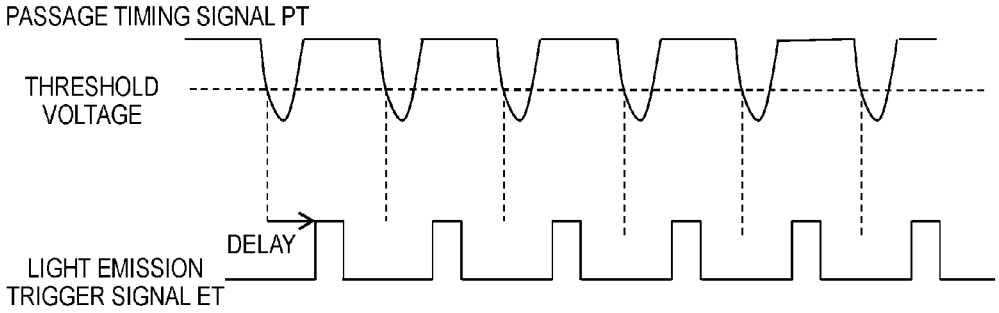
RELATED ART Fig. 2C
FIG. 2C is a timing chart of a passage timing signal and a light emission trigger signal in the EUV light generation system in the related art.

FIG. 2C is a timing chart of a passage timing signal PT and a light emission trigger signal ET in the EUV light generation system 11 in the related art. The optical intensity of the light received by the photodetector 41 may drop synchronously with the passage of a target 27 through the focal region 40. The photodetector 41 may detect the change in optical intensity and output this detection result to the laser controller 55 using the passage timing signal PT. Each time a target 27 is detected, one detection pulse may be outputted to the laser controller 55 in the passage timing signal PT.

The laser controller 55 may output a light emission trigger to the laser apparatus 3 with a predetermined delay time from the time when the passage timing signal PT falls below a threshold voltage. The light emission trigger is a pulse in the light emission trigger signal ET.

The laser controller 55 may receive a burst signal BT from the exposure apparatus 6 via the EUV light generation controller 5. The burst signal BT may be a signal for instructing the EUV light generation system 11 to generate EUV light within a specified period. The laser controller 55 may perform control to output EUV light to the exposure apparatus 6 during the specified period.

The laser controller 55 may control the laser apparatus 3 to output a pulse laser beam in accordance with the passage timing signal PT in the period where the burst signal BT is ON. The laser controller 55 may control the laser apparatus 3 not to output a pulse laser beam in the period where the burst signal BT is OFF.

For example, the laser controller 55 may output the burst signal BT received from the exposure apparatus 6 and a light emission trigger signal ET delayed by a predetermined time from the passage timing signal PT to the laser apparatus 3. When the burst signal BT is ON, the laser apparatus 3 may output a pulse laser beam in response to a light emission trigger pulse of the light emission trigger signal ET. The outputted pulse laser beam may be inputted to the laser beam focusing optical system 22*a* via the laser beam direction control unit 34.

4.3 Issues

When plasma is generated by irradiating a target 27 with a pulse laser beam, the trajectories 271 of the targets 27 to be irradiated later may be displaced from the normal trajectory 271 of targets 27. The reason may be explained because pressure waves 255 caused by generation of plasma vibrate the target supply device 26 to destabilize the trajectories 271 of the targets 27.

Specifically, when a target 27 is irradiated with a pulse laser beam, the surface of the target instantaneously may turn into plasma and rapidly expand to generate a pressure wave 255. The inside of the chamber 2 may be held at gas pressure of several to several tens of Pa and the generated pressure wave 255 may propagate within the chamber 2. When the pressure wave 225 reaches the target supply device 26, the target supply device 26 may vibrate. The target output position may vibrate with the vibration of the target supply device 26, so that the trajectories 271 of the targets 27 may become unstable.

When the trajectory 271 of some target 27 is displaced, the target 27 may not pass through the focal region 40 of the timing sensor 450, so that a light emission trigger may not be generated. As a result, the target 27 may not be irradiated with the pulse laser beam and the generation of EUV light may be interrupted.

In another case, even if a target 27 traveling along a displaced trajectory 271 has passed through the focal region 40 of the timing sensor 450, the target 27 may not pass through the plasma generation region 25. In this case, a pulse laser beam is outputted but the target 27 is not irradiated; EUV light may not be generated. Alternatively, if the target trajectory 271 is off a desired position in the plasma generation region 25, the irradiated area of the target may be insufficient in the irradiation with the pulse laser beam; the energy of the EUV light may drop.

5. Embodiment 1

5.1 Configuration

Figure 3A:
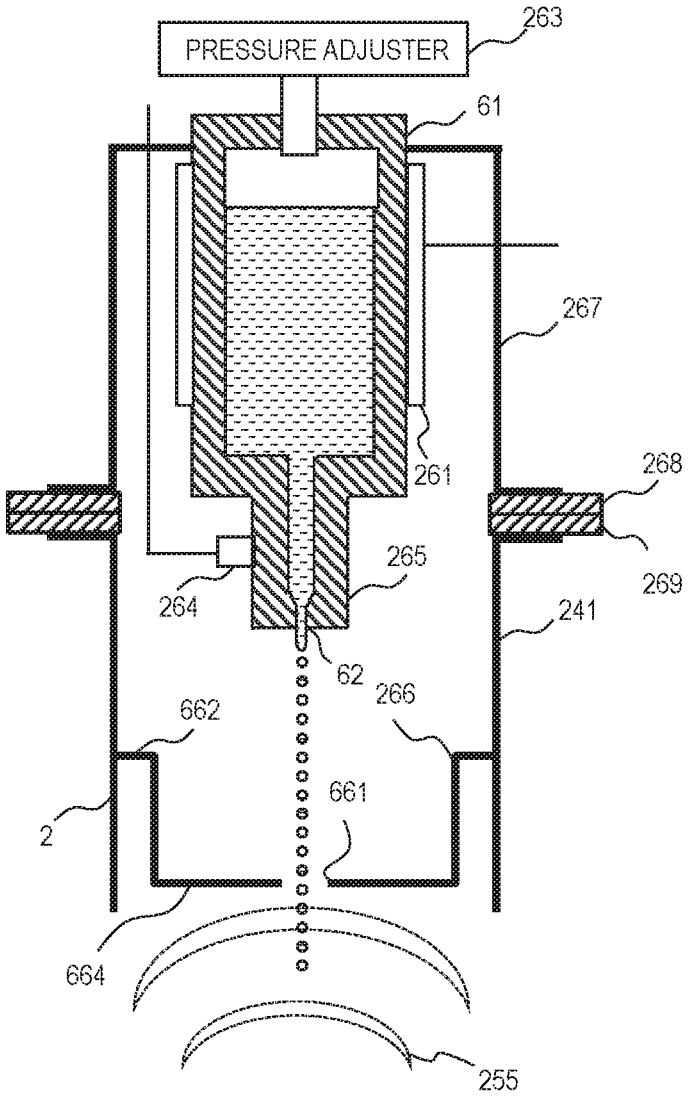
FIG. 3A illustrates a partial configuration of an EUV light generation system in Embodiment 1.
Figure 3B:
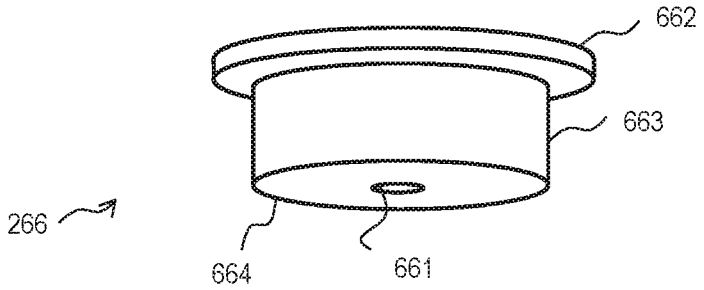
FIG. 3B is a perspective view of a shield cover in Embodiment 1.

FIG. 3A illustrates a partial configuration of an EUV light generation system 11 in the present embodiment. FIG. 3B is a perspective view of a shield cover 266. Hereinafter, differences from the related art described with reference to FIGS. 2A to 2C are mainly described.

As shown in FIG. 3A, the shield cover 266 may be disposed between the nozzle opening 62 of the target supply device 26 and the focal region 40. The nozzle opening 62 may be located upstream on the target trajectory 271 and the focal region 40 may be located downstream.

The shield cover 266 may be disposed on the target trajectory 271 starting from the target supply device 26 and reaching the plasma generation region 25. The shield cover 266 may be fixed to the inner wall of the chamber 2 at a place closer to the plasma generation region 25 than the supporter 269 of the stage 268. For example, the shield cover 266 may be welded or bonded with an adhesive to the inner face of the wall 241 of the chamber 2. The shield cover 266 may be fixed to the stage 268, the stage supporter 269, or the container 267.

As illustrated in FIG. 3B, the shield cover 266 may have a cylindrical side 663. The upstream end of the side 663 may be provided with an annular flange 662. The downstream end of the side 663 may be provided with a disc-shaped exit face 664. The exit face 664 may have a through-hole 661 at substantially the center thereof to pass the target 27 therethrough.

As illustrated in FIG. 3A, the shield cover 266 may be disposed to cover the target supply device 26 against the plasma generation region 25. The target supply device 26 may be exposed to the plasma generation region 25 only from the through-hole 661.

The area of the opening of the through-hole 661 may be determined based on the variations in target trajectory 271. The area of the opening of the through-hole 661 may be determined based on the movable range of the stage 268 if the shield cover 266 is fixed to the chamber 2. The area of the opening of the through-hole 661 may be determined based on the wavelength of the pressure waves 225. For example, the shape of the through-hole 661 may be a circle having a diameter of about 10 mm to 50 mm or a rectangle having a side of about 10 mm to 80 mm.

The shape and the material of the shield cover 266 may be determined so that the shield cover 266 will not resonate with the pressure waves 255. For example, the shield cover 266 may be made of a metal having a thickness of about 3 mm. The metal may be aluminum, for example.

5.2 Operation

A target 27 outputted from the target supply device 26 may enter the shield cover 266 through the flange 662 formed on the target entrance end of the shield cover 266. The target 27 may pass inside the side 663 to approach the exit face 664 formed on the target exit end of the shield cover 266. The target 27 may pass through the through-hole 661 formed in the exit face 664.

The target 27 may be detected at the focal region 40 by the timing sensor 450. The laser apparatus 3 may output a pulse laser beam synchronously with the detection of the target 27. The target 27 may reach the plasma generation region 25 and be irradiated with the pulse laser beam. The irradiation of the target 27 with the pulse laser beam may generate plasma. Pressure waves 255 may be generated with the generation of plasma. The shield cover 266 may hamper the propagating pressure waves 255 from reaching the target supply device 26.

5.3 Effects

The propagation of the pressure waves 255 may be blocked by the shield cover 266. The shield cover 266 may significantly attenuate the pressure waves 255 that are reaching the target supply device 26. As a result, the shield cover 266 may prevent vibration of the target supply device 26 caused by the pressure waves 255 and prevent instability of the target trajectory 271. In the configuration where the shield cover 266 is fixed to the chamber 2, the vibration transmitted from the shield cover 266 to the stage 268 may be attenuated by the chamber 2 and the movable part of the stage 268.

6. Embodiment 2

6.1 Configuration

Figure 4A:
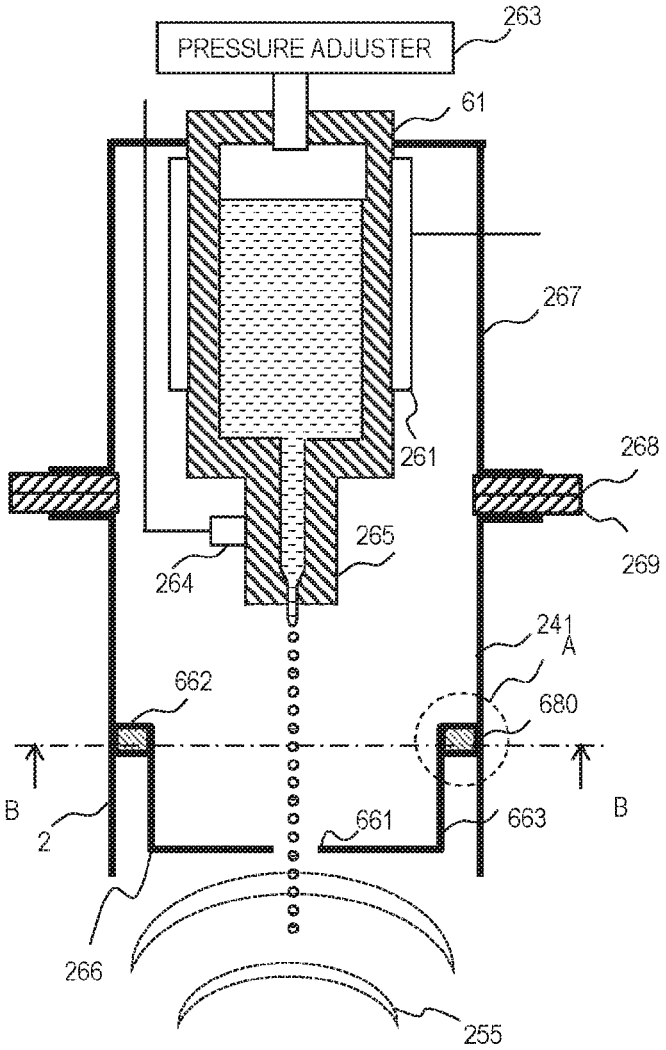
FIG. 4A illustrates a manner of fixing the shield cover in Embodiment 2.

FIGS. 4A to 4E illustrate manners of fixing the shield cover 266 in the present embodiment. Hereinafter, differences from Embodiment 1 are mainly described. As shown in FIG. 4A, the shield cover 266 may be fixed to the part for supporting the shield cover 266 with a damper 680 interposed therebetween. For example, the shield cover 266 may be fixed to the inner face of the wall 241 of the chamber 2 with the damper 680. The shield cover 266 may be supported only by the damper 680 and does not need to be in direct contact with the chamber 2.

Figure 4B:
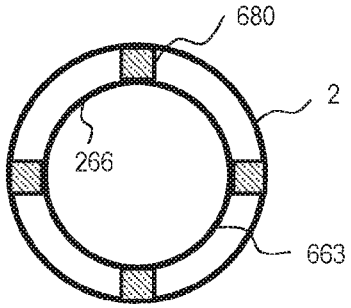
FIG. 4B is a cross-sectional diagram cut along the B-B line in FIG. 4A.

FIG. 4B is a cross-sectional view cut along the B-B line in FIG. 4A. As shown in FIG. 4B, a plurality of dampers 680 may be disposed at a plurality of places around the outer circumference of the shield cover 266. As shown in the example of FIG. 4B, four dampers 680 may be disposed circumferentially and away from each other on the outer face of the side 663. The dampers 680 may be equally spaced. Alternatively, one damper 680 may be disposed around the entire outer rim of the shield cover 266.

Figure 4C:
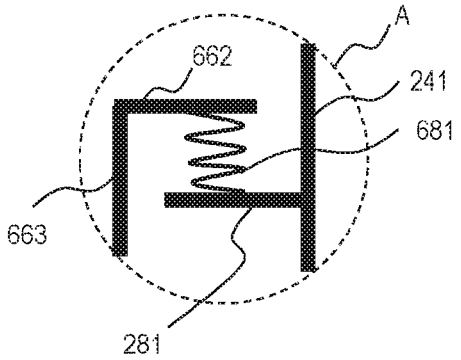
FIG. 4C illustrates a manner of fixing the shield cover in Embodiment 2.
Figure 4D:
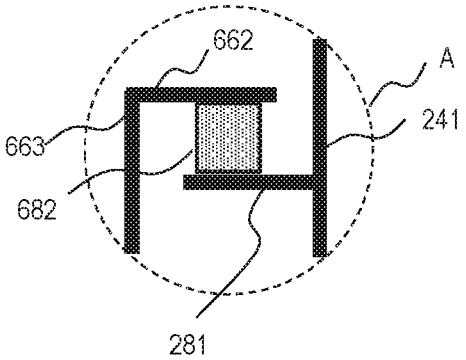
FIG. 4D illustrates a manner of fixing the shield cover in Embodiment 2.
Figure 4E:
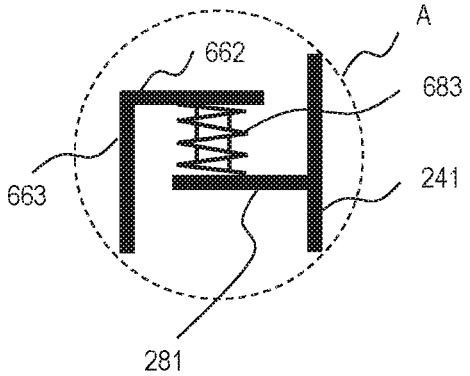
FIG. 4E illustrates a manner of fixing the shield cover in Embodiment 2.

FIGS. 4C to 4E illustrate configurations in the region A in FIG. 4A. As shown in FIG. 4C, the damper 680 may be a spring 681. A mount 281 may be provided on the inner wall of the chamber 2. The mount 281 may be an annular part projecting from the inner face of the wall 241 of the chamber 2 toward the target trajectory 271. A plurality of mounts 281 may be provided away from each other, correspondingly to a plurality of springs 681.

The spring 681 may be disposed and fixed between the flange 662 of the shield cover 266 and the mount 281. The spring 681 may be disposed between the face on the downstream side of the target trajectory of the flange 662 and the face on the upstream side of the target trajectory of the mount 281.

The outer circumference of the flange 662 may be apart from the inner wall of the chamber 2. When seen from the plasma generation region 25, the flange 662 may be overlapped with the mount 281. As seen from the plasma generation region 25, the target supply device 26 does not need to be exposed from the gap between the flange 662 and the inner wall of the chamber 2. The flange 662 may be disposed on the downstream side of the target trajectory of the mount 281.

The damper 680 may be another elastic body. For example, the damper 680 may be a rubber cushion 682 as illustrated in FIG. 4D. The damper 680 may be a bellows 683 as illustrated in FIG. 4E. The disposition of the rubber cushion 682 and the bellows 683 may be the same as the disposition of the spring 681 explained with reference to FIG. 4C.

6.2 Operation and Effects

The shield cover 266 for blocking the propagation of pressure waves 255 generated by generation of plasma to the target supply device 26 may vibrate because of the pressure waves 255. The vibration of the shield cover 266 may be attenuated by the damper 680. Accordingly, the vibration of the shield cover 266 may be prevented from being transmitted to the target supply device 26 through the chamber 2.

7. Embodiment 3

Debris from plasma or part of the targets 27 bouncing off the target collector 28 may adhere to the nozzle opening 62 of the nozzle 265 to destabilize the trajectories 271 of the targets 27. For this reason, the EUV light generation system 11 in the present embodiment may supply purge gas to the vicinity of the nozzle 265 along a purge gas supply channel partially defined by a shield cover 266 to prevent the variation in target trajectory 271 caused by the deposit on the nozzle opening 62 of the nozzle 265. Hereinafter, differences from Embodiment 1 are mainly described.

7.1 Configuration

Figure 5:
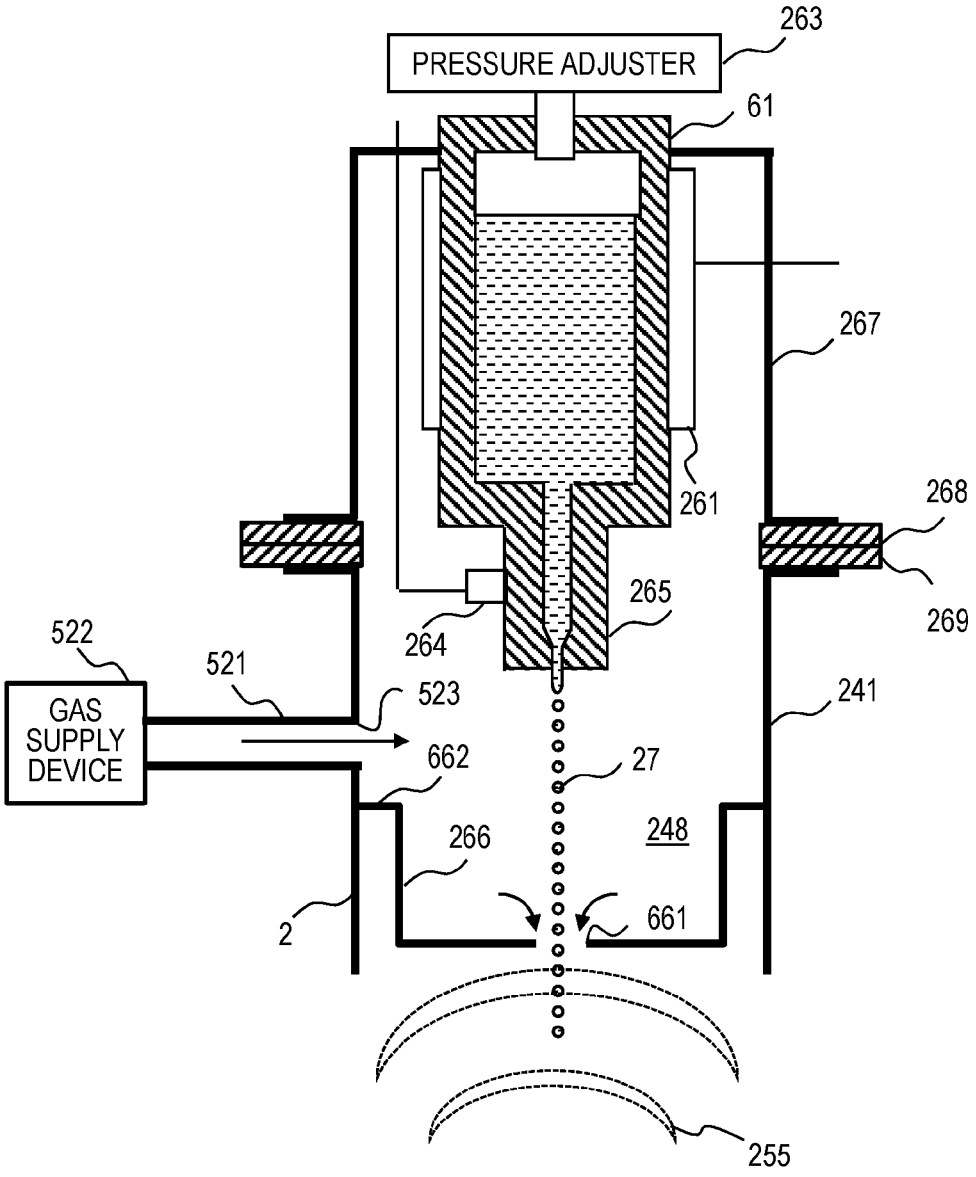
FIG. 5 illustrates a partial configuration of an EUV light generation system in Embodiment 3.

FIG. 5 illustrates a partial configuration of the EUV light generation system 11 in the present embodiment. The EUV light generation system 11 may supply purge gas to a space 248 partially defined by the shield cover 266 and accommodating the target supply device 26.

A gas introduction part defining a gas introduction port 523 may be located on the opposite side of the plasma generation region 25 across the shield cover 266. The gas introduction port 523 may be provided in the accommodation space 248 for the target supply device 26. The gas introduction port 523 may be provided on the wall 241 of the chamber 2 on the target supply device side of the shield cover 266. The gas introduction port 523 may be provided on the container 267 of the target supply device 26. The gas introduction port 523 may be located between the through-hole 661 of the shield cover 266 and the nozzle opening 62 with respect to the direction of the target trajectory. A gas introduction tube 521 is connected with the gas introduction port 523. The gas introduction tube 521 may connect the gas supply device 522 and the gas introduction port 523.

The gas supply device 522 may supply gas including hydrogen for the purge gas. The EUV light generation controller 5 may control the supply of the purge gas by the gas supply device 522.

7.2 Operation and Effects

The purge gas may flow from the gas supply device 522 to the gas introduction port 523 through the gas introduction tube 521. The purge gas may flow into the accommodation space 248 for the target supply device 26 from the gas introduction port 523. The purge gas may flow to the through-hole 661 of the shield cover 266 and flow out from the through-hole 661 toward the plasma generation region 25.

The flow of the purge gas ejecting from the through-hole 661 in the direction of movement of the targets 27 may prevent the debris from plasma or targets 27 bouncing off the target collector 28 from adhering to the nozzle 265. As a result, variation in target trajectory 271 caused by the deposit on the nozzle 265 may be prevented.

8. Embodiment 4

The nozzle 265 may be sputtered with fast ions and fast atoms from the plasma. As a result, the wettability of the nozzle 265 may increase so that the debris may easily adhere to the nozzle 265. The EUV light generation system 11 in the present embodiment may further include a plasma shield in addition to the shield cover 266 to prevent sputtering to the nozzle 265 with the fast particles from plasma. Hereinafter, differences from Embodiment 3 are mainly described.

8.1 Configuration

Figure 6:
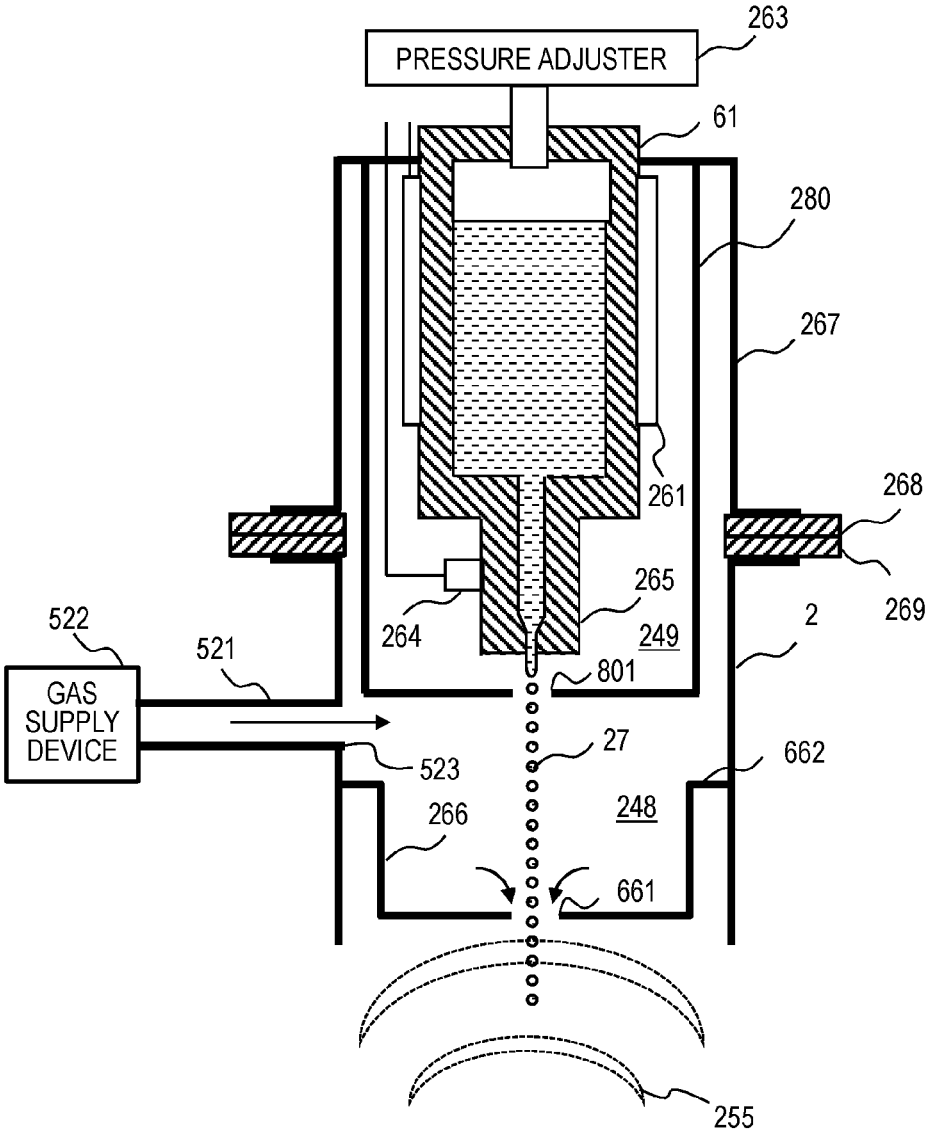
FIG. 6 illustrates a partial configuration of an EUV light generation system in Embodiment 4.

FIG. 6 illustrates a partial configuration of the EUV light generation system 11 in the present embodiment. The plasma shield 280 may be disposed in the accommodation space 248 for the target supply device 26 partially defined by the shield cover 266. The plasma shield 280 may be disposed between the shield cover 266 and the target supply device 26. The plasma shield 280 may be fixed to the container 267 of the target supply device 26. The target supply device 26 may be accommodated in the space 249 defined by the plasma shield 280 and the container 267.

The plasma shield 280 may be made of a conductive material and include a through-hole 801 through which targets 27 may be able to pass. The plasma shield 280 may be made of aluminum having a thickness of several millimeters. When seen from the plasma generation region 25, the target supply device 26 may be exposed only from the through-hole 801.

The through-hole 801 of the plasma shield 280 fixed to the stage 268 with the container 268 may be moved by the stage 268 together with the nozzle 265. Accordingly, the through-hole 801 may be smaller than the through-hole 661 of the shield cover 266 fixed to the chamber 2. The through-hole 801 may be circular or rectangular. The through-hole 801 may be circular and have a diameter of several millimeters, for example. The gas introduction port 523 may be located between the through-hole 661 of the shield cover 266 and the through-hole 801 of the plasma shield 280 with respect to the direction of the target trajectory.

8.2 Operation and Effects

The purge gas that has flowed in from the gas introduction port 523 may flow to the through-hole 661 of the shield cover 266 and jet out from the through-hole 661 toward the plasma generation region 25. The flow of the purge gas in the through-hole 661 may reduce the deposit on the nozzle 265. Furthermore, the plasma shield 280 may prevent the nozzle 265 from being sputtered with the fast ions and fast atoms that cannot be blocked by the purge gas jetting out from the through-hole 661 of the shield cover 266.

The amount of the purge gas flowing in through the through-hole 801 of the plasma shield 280 may be much less than the amount of the purge gas flowing in through the through-hole 661. Such a small amount of purge gas may not affect the trajectories 271 of the targets 27 that have just been ejected from the nozzle 265, so that the displacement of the targets 27 in the plasma generation region 25 may be effectively prevented. In the configuration where multiple targets 27 outputted from the nozzle 265 are joined into one target 27 and the joined target 27 is irradiated with the pulse laser beam at the plasma generation region 25, the through-hole 801 may be provided downstream of the position where the multiple targets 27 are joined. This configuration may prevent failure in joining of small targets 27 caused by unstable trajectories of the small targets 27 that are easily displaced.

9. Embodiment 5

9.1 Configuration

Figure 7:
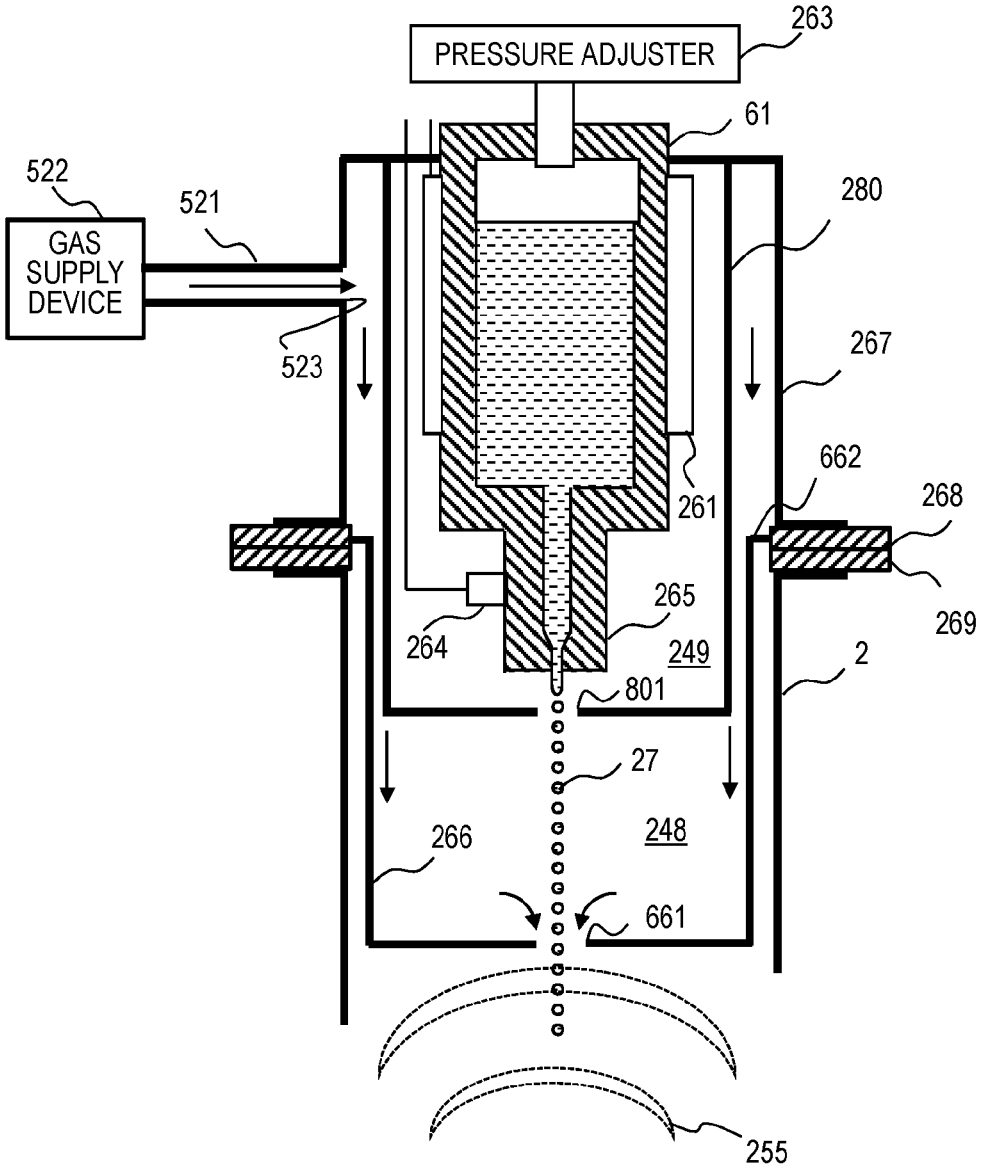
FIG. 7 illustrates a partial configuration of an EUV light generation system in Embodiment 5.

FIG. 7 illustrates a partial configuration of an EUV light generation system 11 in the present embodiment. Hereinafter, differences from Embodiment 4 are mainly described. The shield cover 266 may be fixed to the stage 268. The shield cover 266 may be fixed to the stage with a damper interposed therebetween. The shield cover 266 may move with the nozzle 265 of the target supply device 26 when the stage 268 is moved.

The size of the through-hole 661 may be equal to the size of the through-hole 801 of the plasma shield 280. For example, the diameter may be several millimeters to ten millimeters. The through-hole 661 may be larger than the through-hole 801. The through-hole 661 larger than the through-hole 801 may prevent the targets 27 that have passed through the through-hole 801 but are traveling along displaced trajectories 271 from hitting the shield cover 266.

The gas introduction port 523 may be formed on the container 267 of the target supply device 26. The through-hole 801 of the plasma shield 280 may be located between the gas introduction port 523 and the through-hole 661 of the shield cover 266 with respect to the direction of the target trajectory. The gas introduction port 523 may face the side wall of the plasma shield 280. The space 249 defined by the plasma shield 280 and the container 267 and accommodating the target supply device 26 may be closed except for the gas introduction port 523 and the through-hole 801.

9.2 Operation and Effects

The through-hole 661 of the shield cover 266 may move together with the nozzle 265 when the stage 268 is moved. Accordingly, the through-hole 661 of the shield cover 266 may be allowed to be small, compared to the through-hole 661 of the shield cover 266 fixed to the chamber 2. The small through-hole 661 may more effectively hamper the pressure waves 255 and the particles from reaching the target supply device 26. The movable part for moving the stage 268 may attenuate the vibration of the shield cover 266 caused by the pressure waves 255.

10. Embodiment 6

The chamber 2 may expand or deform because of the heat from the plasma. The EUV light generation system 11 in the present embodiment may further include a heat shield 256 in addition to the shield cover 266, to prevent the expansion and deformation of the chamber 2. Hereinafter, differences from Embodiment 3 are mainly described.

10.1 Configuration

Figure 8A:
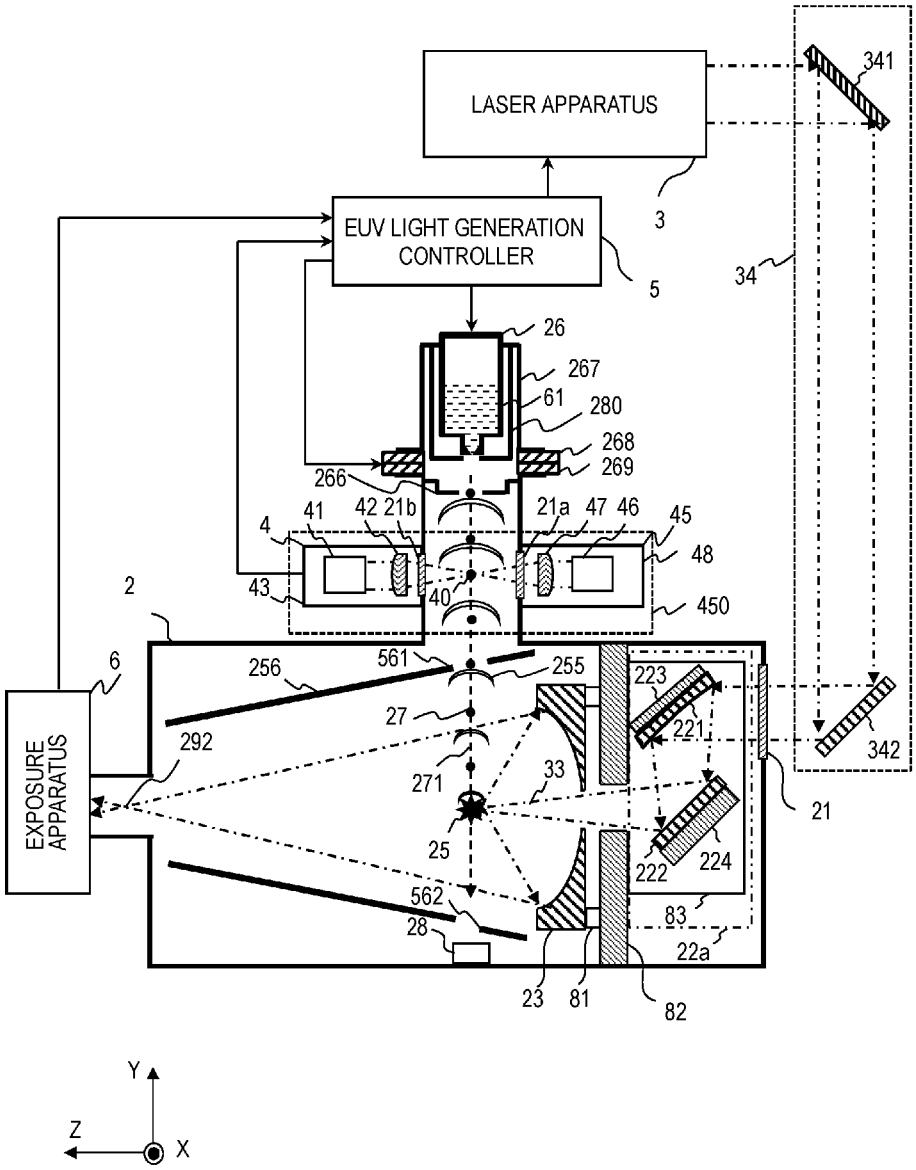
FIG. 8A is a cross-sectional diagram of a configuration example of an EUV light generation system in Embodiment 6.

FIG. 8A is a cross-sectional diagram of a configuration example of the EUV light generation system 11 in the present embodiment. A heat shield 256 may be provided in the chamber 2. The heat shield 256 may be provided between the shield cover 266 and the plasma generation region 25. The heat shield 256 may accommodate the plasma generation region 25.

The heat shield 256 may absorb the heat of the radiant light from the plasma or laser scattering light. As a result, thermal deformation of the chamber 2 caused by absorption of the heat of the radiant light from the plasma or laser scattering light may be reduced.

The heat shield 256 may have a tubular shape and have through-holes 561 and 562 in the side walls. The sizes of the through-holes 561 and 562 may be several tens millimeters, for example, and larger than the through-hole 661 of the shield cover 266. The through-hole 561 may be an opening for passing the targets 27 outputted from the target supply device 26, having passed through the focal region 40, and traveling toward the plasma generation region 25. The through-hole 562 may be formed to oppose to the through-hole 561. The through-hole 562 may be an opening for passing the targets 27 to be collected into the target collector 28.

Figure 8B:
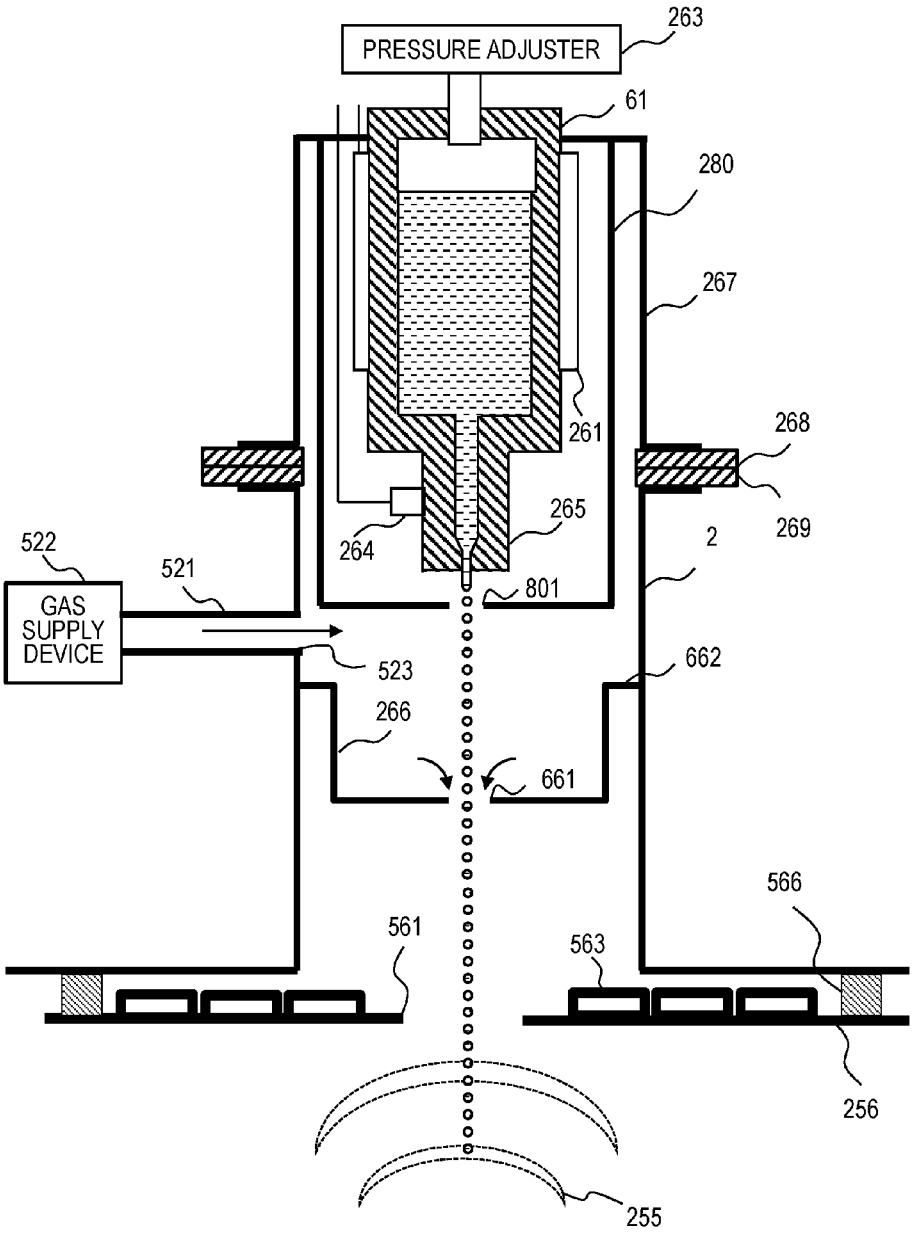
FIG. 8B illustrates a partial configuration of the EUV light generation system in Embodiment 6.

FIG. 8B illustrates a partial configuration of the EUV light generation system 11 in the present embodiment. The heat shield 256 may be fixed to the inner wall of the chamber 2 with a damper 566 interposed therebetween. The damper 566 may be the same as the damper 680 explained in Embodiment 2. The damper 566 may have a structure that reduces the transmission of the expansion or deformation stress caused by the heat of the heat shield 256 to the chamber 2 and be made of a material that reduces the transmission of the expansion or deformation stress caused by the heat of the heat shield 256 to the chamber 2.

The heat shield 256 may include a cooling medium channel 563. The cooling medium channel 563 may be provided on the side wall of the heat shield 256. The cooling medium may flow in the cooling medium channel 563. The cooling medium may prevent thermal deformation caused by overheat of the heat shield 256. The heat shield 256 may be made of a metal, for example, aluminum.

10.2 Operation and Effects

The heat shield 256 may reduce the thermal deformation of the chamber 2 and attenuate the pressure waves 255 to reach the shield cover 266. The heat shield 256 may prevent the pressure waves 255 from reaching the wall of the chamber 2. The heat shield 256 may reduce the pressure waves 255 that reaches the target supply device 26 and the vibration of the target supply device 26 caused by the pressure waves 255 further.

11. Embodiment 7

The pressure waves 255 may propagate in various directions from the plasma generation region 25 and be reflected inside the chamber 2. For example, the pressure waves 255 reflected in a complex manner inside the chamber 2 may amplify one another to vibrate the chamber 2. Such vibration may be transmitted to the target supply device 26 through the chamber 2 and the components attached to the chamber 2. The EUV light generation system 11 may include a pressure-wave attenuator for attenuating the pressure waves 255. Hereinafter, differences from Embodiment 3 are mainly described.

Figure 9:
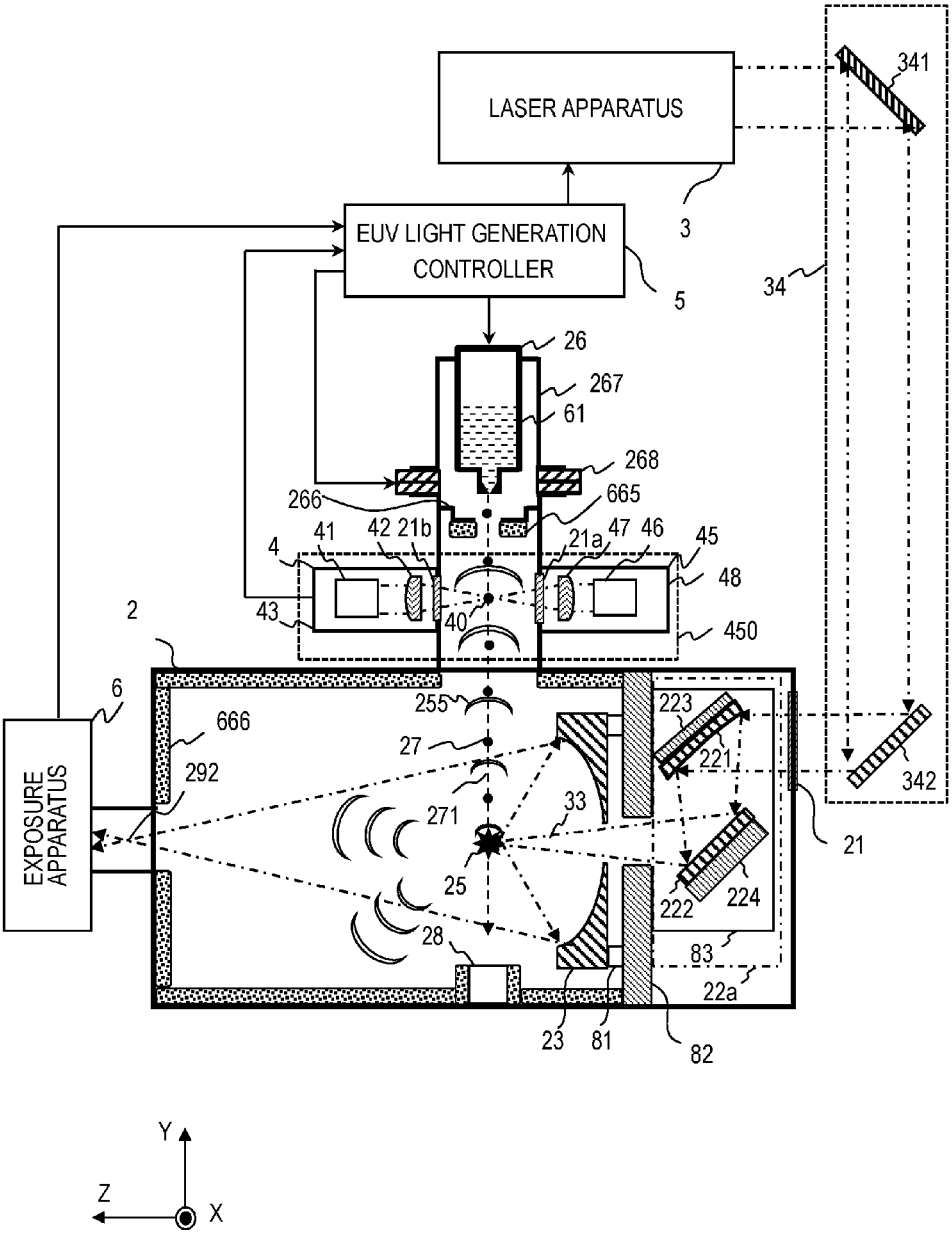
FIG. 9 is a cross-sectional diagram of a configuration example of an EUV light generation system in Embodiment 7.

FIG. 9 is a cross-sectional diagram of a configuration example of the EUV light generation system 11 in the present embodiment. A pressure-wave attenuator 666 may be provided on the inner wall of the chamber 2. A pressure-wave attenuator 665 may be provided on the face of the shield cover 266 facing the plasma generation region 25. The pressure-wave attenuators 665 and 666 may be made of a porous material. The porous material may be porous ceramics or a foam metal.

The pressure-wave attenuators 665 and 666 may reduce the reflection of the pressure waves 255 inside the chamber 2. The pressure-wave attenuator 665 on the shield cover 266 may effectively reduce the vibration of the shield cover 266 caused by the pressure waves 255.

As set forth above, the present invention has been described with reference to some embodiments; however, the scope of the present invention is not limited to the foregoing embodiments. A part of the configuration of an embodiment may be replaced with a configuration of another embodiment. A configuration of an embodiment may be incorporated to a configuration of another embodiment. A part of the configuration of each embodiment may be removed, added to a different configuration, or replaced by a different configuration.

The terms used in this specification and the appended claims should be interpreted as "non-limiting". For example, the terms "include" and "be included" should be interpreted as "including the stated elements but not limited to the stated elements". The term "have" should be interpreted as "having the stated elements but not limited to the stated elements". Further, the modifier "one (a/an)" should be interpreted as "at least one" or "one or more."

What is claimed is:

1. An extreme ultraviolet light generation apparatus configured to generate extreme ultraviolet light by irradiating a target with a pulse laser beam outputted from a laser apparatus to generate plasma, the extreme ultraviolet light generation apparatus comprising:

a chamber;

a target supply device configured to supply a target to a plasma generation region inside the chamber;

a target sensor located between the target supply device and the plasma generation region and configured to detect the target passing through a detection region;

a shield cover disposed between the detection region and the target supply device, having a through-hole that allows the target to pass through, and configured to reduce pressure waves that reach the target supply device from the plasma generation region;

a heat shield disposed between the plasma generation region and the shield cover, structured to accommodate the plasma generation region, having a through hole that allows the target to pass through, and configured to reduce heat conducted to the chamber from the plasma generation region; and a first damper between the heat shield and an inner wall of the chamber.

2. The extreme ultraviolet light generation apparatus according to claim 1, wherein the shield cover is fixed to the chamber with a second damper interposed between the shield cover and the chamber.

3. The extreme ultraviolet light generation apparatus according to claim 2, further comprising:

a stage configured to move the target supply device; and a supporter fixed to the chamber and configured to support the stage.

4. The extreme ultraviolet light generation apparatus according to claim 1, further comprising a gas introduction device disposed on the opposite side of the plasma generation region across the shield cover and configured to supply purge gas to a space between the target supply device and the shield cover.

5. The extreme ultraviolet light generation apparatus according to claim 1, further comprising a plasma shield disposed between the shield cover and the target supply device, having an opening that allows the target to pass through, and configured to reduce particles that reach the target supply device from the plasma generation region.

6. The extreme ultraviolet light generation apparatus according to claim 1, further comprising a pressure wave attenuator disposed on the shield cover to face the plasma generation region.

7. The extreme ultraviolet light generation apparatus according to claim 1, wherein the shield cover is fixed to the chamber with a plurality of second dampers interposed between the shield cover and the chamber.

8. The extreme ultraviolet light generation apparatus according to claim 7, wherein each of the plurality of second dampers is one of a spring, a rubber cushion, and a bellows.

9. The extreme ultraviolet light generation apparatus according to claim 3, wherein the shield cover is fixed to the stage.

10. The extreme ultraviolet light generation apparatus according to claim 1, further comprising:

a stage configured to move the target supply device; and a supporter fixed to the chamber and configured to support the stage, wherein the shield cover is fixed to the stage.

11. The extreme ultraviolet light generation apparatus according to claim 1, wherein the shield cover is made of a metal.

12. The extreme ultraviolet light generation apparatus according to claim 4, wherein the gas includes hydrogen.

13. The extreme ultraviolet light generation apparatus according to claim 5, wherein the opening of the plasma shield is smaller than the through-hole of the shield cover.

14. The extreme ultraviolet light generation apparatus according to claim 5, further comprising:

a stage configured to move the target supply device; and a supporter fixed to the chamber and configured to support the stage, wherein the plasma shield is fixed to the stage and moved by the stage with the target supply device.

15. The extreme ultraviolet light generation apparatus according to claim 6, wherein the pressure wave attenuator is made of a porous material.

16. The extreme ultraviolet light generation apparatus according to claim 15, wherein the porous material includes porous ceramics or a foam metal.

17. The extreme ultraviolet light generation apparatus according to claim 1, wherein the through hole of the heat shield is larger than the through-hole of the shield cover.

* * * * *